US008078391B2

(12) United States Patent
Kanazawa

(10) Patent No.: US 8,078,391 B2
(45) Date of Patent: Dec. 13, 2011

(54) ROAD TRAFFIC INFORMATION COMMUNICATING SYSTEM AND METHOD

(75) Inventor: Takeshi Kanazawa, Kanagawa (JP)

(73) Assignee: Panasonic Corporation, Osaka (JP)

( * ) Notice: Subject to any disclaimer, the term of this patent is extended or adjusted under 35 U.S.C. 154(b) by 898 days.

(21) Appl. No.: 11/568,052

(22) PCT Filed: Apr. 19, 2005

(86) PCT No.: PCT/JP2005/007464

§ 371 (c)(1),
(2), (4) Date: Oct. 18, 2006

(87) PCT Pub. No.: WO2005/104057

PCT Pub. Date: Nov. 3, 2005

(65) Prior Publication Data

US 2008/0201066 A1 Aug. 21, 2008

(30) Foreign Application Priority Data

Apr. 22, 2004 (JP) ..... 2004-127241

(51) Int. Cl.

| | |
|---|---|
| ***G08G 1/123*** | (2006.01) |
| ***G08G 1/017*** | (2006.01) |
| ***G08G 1/01*** | (2006.01) |
| ***G08G 1/056*** | (2006.01) |

(52) U.S. Cl. ..... 701/118

(58) Field of Classification Search ..... 701/4, 70, 701/118, 207, 213, 216, 300, 301; 340/436, 340/933, 988, 825.49; 342/118, 140, 142, 342/147

See application file for complete search history.

(56) References Cited

U.S. PATENT DOCUMENTS

| | | | | |
|---|---|---|---|---|
| 5,589,827 | A | 12/1996 | Scurati | |
| 6,647,268 | B1 | 11/2003 | Tsuchida et al. | |
| 2002/0027511 | A1 * | 3/2002 | Horita et al. | 340/988 |
| 2002/0030611 | A1 * | 3/2002 | Nuesser et al. | 340/992 |
| 2003/0144795 | A1 * | 7/2003 | Lin | 701/213 |

(Continued)

FOREIGN PATENT DOCUMENTS

| | | |
|---|---|---|
| JP | 7-49992 | 2/1995 |
| JP | 2000-357292 | 12/2000 |

(Continued)

OTHER PUBLICATIONS

English language Abstract of JP 2002-175592.

*Primary Examiner* — John Nguyen
*Assistant Examiner* — Rodney P King
(74) *Attorney, Agent, or Firm* — Greenblum & Bernstein, P.L.C.

(57) ABSTRACT

A control section (212) adds first time information from a clock (204) to road traffic information from a light beacon communication device to create road traffic information by first time for storing in a storage device (205). A time judging device (209) receives second time information from other mobile communication terminal and creates an information transmission instruction if the first time of the first time information is more up-to-date than the second time of the second time information. An information selecting section (211) selects and transmits a part of the road traffic information by first time based on other traveling direction information indicative of the traveling direction of other vehicle and traveling direction information from an azimuth finder (208). Upon receiving road traffic information by third time from other mobile communication terminal, the control section (212) overwrites the road traffic information by first time in the storage device (205).

10 Claims, 12 Drawing Sheets

U.S. PATENT DOCUMENTS

| | | | | |
|---|---|---|---|---|
| 2006/0041374 | A1* | 2/2006 | Inoue | 701/207 |
| 2007/0143001 | A1* | 6/2007 | Park et al. | 701/117 |

FOREIGN PATENT DOCUMENTS

| | | |
|---|---|---|
| JP | 2002-123892 | 4/2002 |
| JP | 2002-175592 | 6/2002 |
| JP | 2003-99888 | 4/2003 |
| JP | 2003-217088 | 7/2003 |
| JP | 2004-54412 | 2/2004 |
| JP | 2004-80383 | 3/2004 |

* cited by examiner

ROAD TRAFFIC INFORMATION COMMUNICATING SYSTEM AND METHOD

TECHNICAL FIELD

The present invention relates to a vehicle information and communication system equipped with a plurality of vehicle information and communication apparatuses that are located near a road at intervals and transmit vehicle information, and a plurality of mobile communication terminal apparatuses that are provided in a plurality of vehicles and acquire that vehicle information.

BACKGROUND ART

A vehicle information and communication system (VICS) is employed with the object of reducing economic losses and traffic accidents due to chronic traffic congestion. This vehicle information and communication system uses a light beacon or radio beacon type of radio communication system or wide-area FM multiplex broadcasting, and provides vehicle drivers with various kinds of information such as parking area information, congestion information, radio and weather forecasts, and so forth.

In a conventional vehicle information and communication system, a traffic information service center collects vehicle information such as vehicle congestion information and traffic accident information on an area-by-area basis, artificially creates these vehicle information items as electronic information, and transmits this to relevant vehicle information and communication apparatuses. Each vehicle information and communication apparatus receives and stores vehicle information from the traffic information service center, and when there is a vehicle information acquisition request from a mobile communication terminal apparatus, transmits vehicle information to the relevant mobile communication terminal apparatus.

Therefore, in a conventional vehicle information and communication system, it is necessary to collect vehicle information over a wide range of areas, making real-time information provision difficult. Furthermore, construction circumstances differ from area to area for a vehicle information and communication system that provides general road traffic information, and it may happen that vehicle information cannot be obtained even once before reaching one's destination.

Thus, the system described in Patent Document 1 has been proposed as a vehicle information and communication system. This vehicle information and communication system is equipped with: a detection section that detects the running environment of a vehicle; a communication section that performs transmission and reception of radio signals to/from outside; a control section that determines the distinctive running environment of a vehicle based on a signal from the detection section and, having accumulated information concerning that distinctive running environment, issues that information as a radio signal at predetermined timing via the communication section, and also receives information concerning the distinctive running environment as the radio signal via the communication section; and a reporting section that reports information concerning the distinctive running environment of another vehicle received by the control section to a vehicle occupant.

By this means, it is possible for mobile communication terminal apparatuses of mutually oncoming vehicles to mutually share and report information concerning a distinctive running environment experienced immediately before.

Patent Document 1: Japanese Patent Application Laid-Open No. 2002-175592

DISCLOSURE OF INVENTION

Problems to be Solved by the Invention

However, a problem with the above-described conventional vehicle information and communication system is that, since only information relating to a distinctive running environment acquired by a vehicle itself is accumulated, this is unnecessary information for mobile communication terminal apparatuses of vehicles traveling in the same direction and vehicles crossing from the left or right.

The present invention has been implemented taking into account the problem described above, and it is an object of the present invention to provide a vehicle information and communication system and vehicle information and communication method that enable only necessary information to be selected from vehicle information stored by a mobile communication terminal apparatus of a vehicle, and to be transmitted to a mobile communication terminal apparatus of another vehicle.

Means for Solving the Problems

A vehicle information and communication system of the present invention is equipped with a plurality of vehicle information and communication apparatuses that are located near a road at intervals and transmit vehicle information, and a plurality of mobile communication terminal apparatuses that are provided in a plurality of vehicles, and employs a configuration wherein each of the plurality of mobile communication terminal apparatuses includes: a vehicle information acquisition section that acquires the vehicle information from the vehicle information and communication apparatuses; a clock that measures the current time and generates first time information; a time-specific vehicle information storage section that adds the first time information from the clock to the vehicle information from the vehicle information acquisition section, and generates and stores first time-specific vehicle information; a display section that displays information including the first time-specific vehicle information stored in the time-specific vehicle information storage section; a positional information acquisition section that acquires positional information showing the current position of that mobile communication terminal apparatus; a direction finder that measures the direction of travel of the vehicle equipped with that mobile communication terminal apparatus, and generates direction-of-travel information; a time determination section that receives second time information from another mobile communication terminal apparatus, selects part of the first time-specific vehicle information when the first time of the first time information of the first time-specific vehicle information is newer than the second time of that second time information, and generates an information transmission directive for transmission thereof; an information selection section that, based on other direction-of-travel information showing the direction of travel of another vehicle from the other mobile communication terminal apparatus at the time of generation of the information transmission directive by the time determination section and the direction-of-travel information from the direction finder, selects the part of the first time-specific vehicle information and generates second time-specific vehicle information; an information transmitting section that transmits the second time-specific vehicle information selected by the information selection section to the other mobile communication terminal apparatus; and a storage control section that overwrites the first time-specific vehicle information of the time-specific vehicle information storage section when third time-specific vehicle information is received from another mobile communication terminal apparatus.

Advantageous Effect of the Invention

As explained above, according to the present invention, a mobile communication terminal apparatus of a vehicle can select only necessary information from stored vehicle information, and transmit that information to a mobile communication terminal apparatus of another vehicle.

BEST MODE FOR CARRYING OUT THE INVENTION

Embodiments of the present invention will now be described in detail with reference to the accompanying drawings.

Embodiment 1

Figure 1:
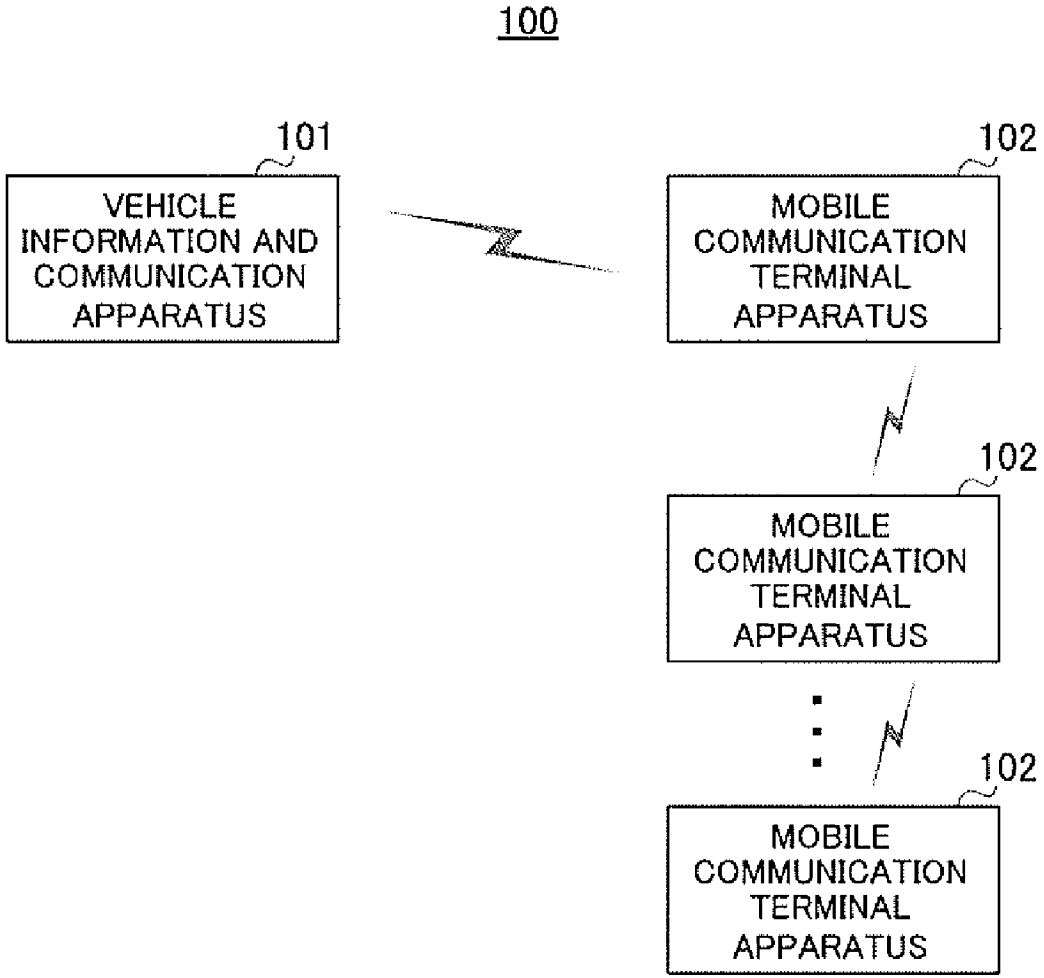
FIG. 1 is a block diagram showing the configuration of a vehicle information and communication system according to Embodiment 1 of the present invention.
Figure 2:
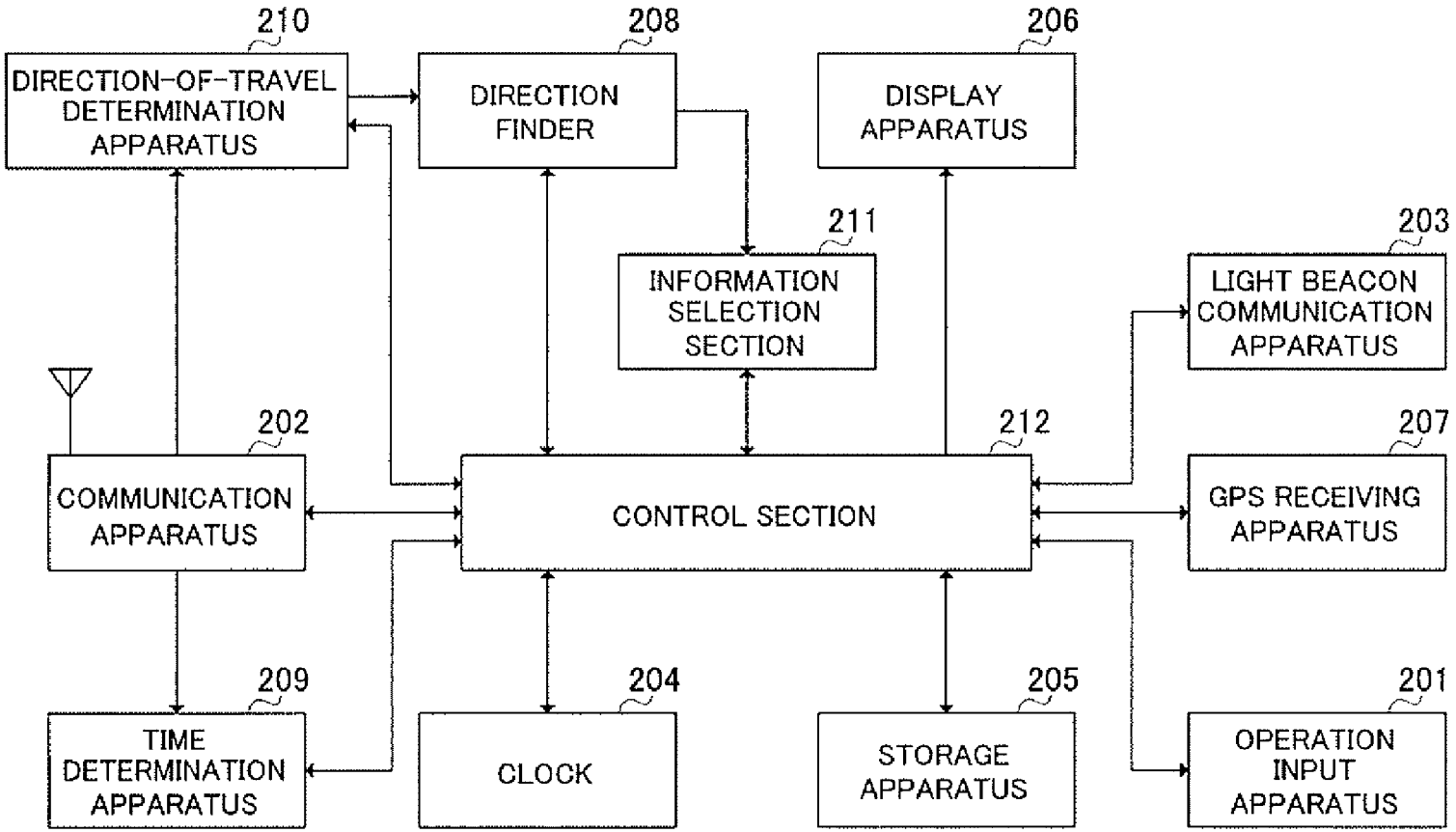
FIG. 2 is a block diagram showing the configuration of a mobile communication terminal apparatus of a vehicle information and communication system according to Embodiment 1 of the present invention.

FIG. 1 is a block diagram showing the configuration of a vehicle information and communication system according to Embodiment 1 of the present invention, and FIG. 2 is a block diagram showing the configuration of a mobile communication terminal apparatus of a vehicle information and communication system according to Embodiment 1 of the present invention.

As shown in FIG. 1, a vehicle information and communication system 100 is equipped with a plurality of vehicle information and communication apparatuses 101 that are located near a road at intervals and transmit vehicle information, and a plurality of mobile communication terminal apparatuses 102 that are provided in a plurality of vehicles.

In vehicle information and communication system 100, a traffic information service center (not shown) collects vehicle information such as vehicle congestion information and traffic accident information on an area-by-area basis, artificially creates these vehicle information items as electronic information, and transmits this to relevant vehicle information and communication apparatuses 101. Each vehicle information and communication apparatus 101 receives and stores vehicle information from the traffic information service center, and when there is a vehicle information acquisition request from a mobile communication terminal apparatus 102, transmits vehicle information to the relevant mobile communication terminal apparatus 102.

As shown in FIG. 2, each mobile communication terminal apparatus 102 is equipped with an operation input apparatus 201, a communication apparatus 202, a light beacon communication apparatus 203, a clock 204, a storage apparatus 205, a display apparatus 206, a GPS receiving apparatus 207, a direction finder 208, a time determination apparatus 209, a direction-of-travel determination apparatus 210, an information selection section 211, and a control section 212.

Control section 212 receives an operation input signal from operation input apparatus 201, and controls communication apparatus 202, light beacon communication apparatus 203, clock 204, storage apparatus 205, display apparatus 206, GPS receiving apparatus 207, direction finder 208, time determination apparatus 209, direction-of-travel determination apparatus 210, and information selection section 211.

Operation input apparatus 201 is operated by an operator such as the driver in order to input an operation input signal to the control section. Communication apparatus 202 performs communication with another mobile communication terminal apparatus 102. Conditional upon being a short distance from each other (for example, 100 m or less), communication apparatuses 202 establish a mutual radio link and perform short-range radio communication, performing communication by means of Bluetooth, infrared communication, a radio LAN communication method typified by IEEE802.11b, or the like.

Light beacon communication apparatus 203 performs communication with vehicle information and communication apparatus 101, acquires vehicle information from vehicle information and communication apparatus 101, and conveys this to control section 212. Clock 204 measures the current time and generates first time information, and conveys this to control section 212. Control section 212 adds first time information from clock 204 to vehicle information from light beacon communication apparatus 203 and generates first time-specific vehicle information, and stores this in storage apparatus 205.

Display apparatus 206 performs image or text display of information including first time-specific vehicle information stored in storage apparatus 205, road maps, traffic information, and various kinds of information for responding to driver inquiries. GPS receiving apparatus 207 receives information from GPS system satellites, and acquires positional information showing the current position of the relevant mobile communication terminal apparatus 102.

Direction finder 208 measures the current direction of travel of the vehicle carrying the relevant mobile communication terminal apparatus 102, generates direction-of-travel information, and conveys this to control section 212. Time determination apparatus 209 receives second time information from another mobile communication terminal apparatus and the first time information of first time-specific vehicle information from storage apparatus 205. Time determination apparatus 209 selects part of the first time-specific vehicle information when the first time of the first time information of the first time-specific vehicle information is newer than the second time of that second time information, generates an information transmission directive for transmission, and conveys this to control section 212.

Direction-of-travel determination apparatus 210 compares other direction-of-travel information showing the direction of travel of another vehicle from another mobile communication terminal apparatus 102 received by communication apparatus 202 with direction-of-travel information of the vehicle itself, determines the direction of travel of the other vehicle with respect to the direction of travel of the vehicle itself, generates a direction-of-travel determination result, and conveys this to control section 212.

Control section 212 conveys an information transmission directive from time determination apparatus 209 and a direction-of-travel determination result from direction-of-travel determination apparatus 210 to information selection section 211. Based on other direction-of-travel information showing the direction of travel of another vehicle from another direction-of-travel determination apparatus 210 and direction-of-travel information from direction finder 208 when an information transmission directive is generated by time determination apparatus 209 (that is, when an information transmission directive is received from time determination apparatus 209 via control section 212)—in other words, based on a direction-of-travel determination result from direction-of-travel determination apparatus 210—information selection section 211 selects part of the first time-specific vehicle information, generates second time-specific vehicle information, and conveys this to control section 212. Second time-specific vehicle information has the same component elements as first time-specific vehicle information.

On receiving second time-specific vehicle information from information selection section 211, control section 212 transmits the second time-specific vehicle information to another mobile communication terminal apparatus 102 via communication apparatus 202.

On receiving third time-specific vehicle information from another mobile communication terminal apparatus 102, communication apparatus 202 of a mobile communication terminal apparatus 102 conveys this to control section 212. Third time-specific vehicle information has the same component elements as first time-specific vehicle information. On receiving third time-specific vehicle information from communication apparatus 202, control section 212 overwrites the first time-specific vehicle information in storage apparatus 205 with the third time-specific vehicle information.

The actual operation of a vehicle information and communication system according to Embodiment 1 of the present invention will now be described with reference to the accompanying drawings.

Figure 3:
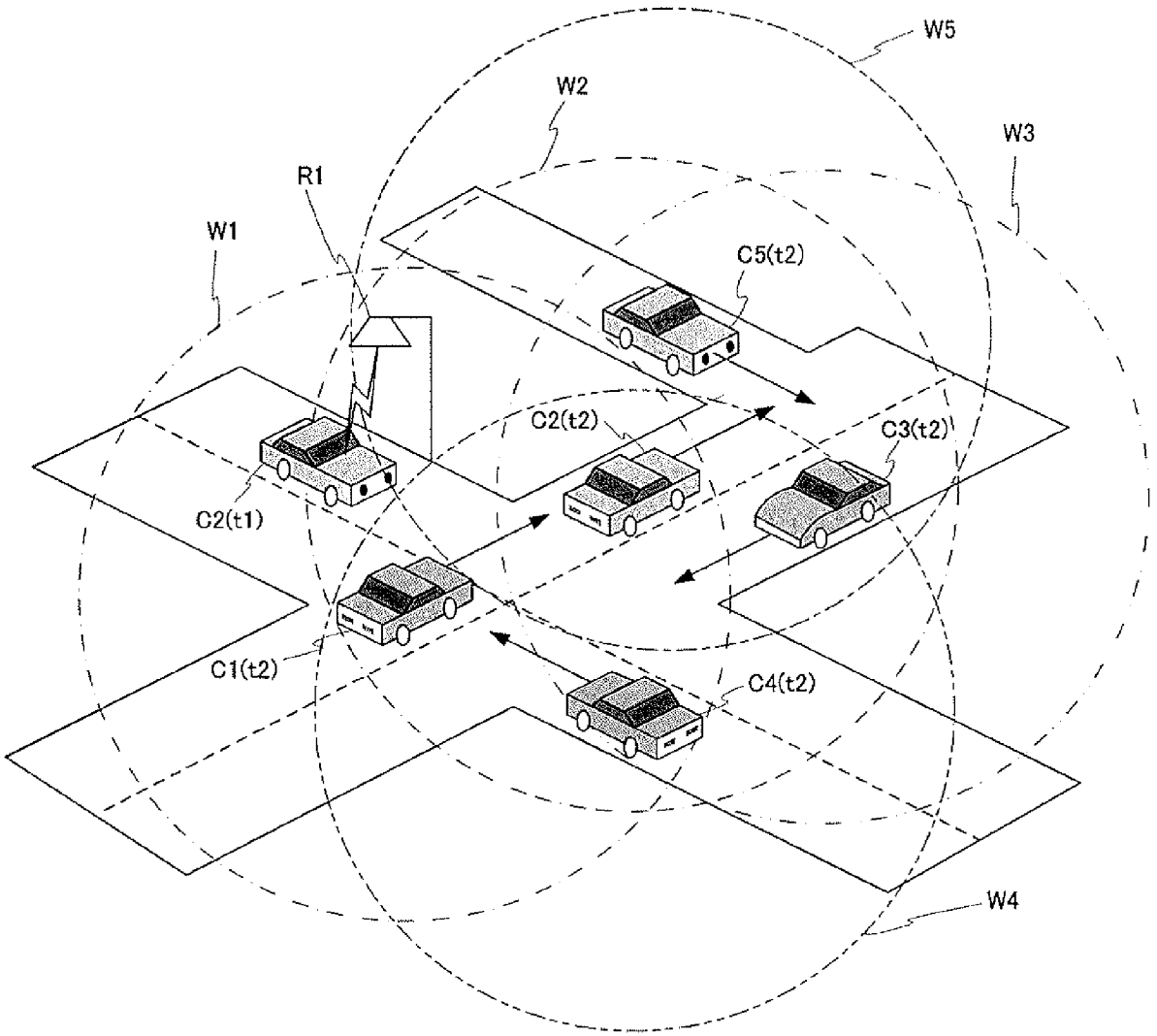
FIG. 3 is a drawing showing vehicles and a vehicle information and communication apparatus for explaining the actual operation of a vehicle information and communication system according to Embodiment 1 of the present invention.
Figure 5:
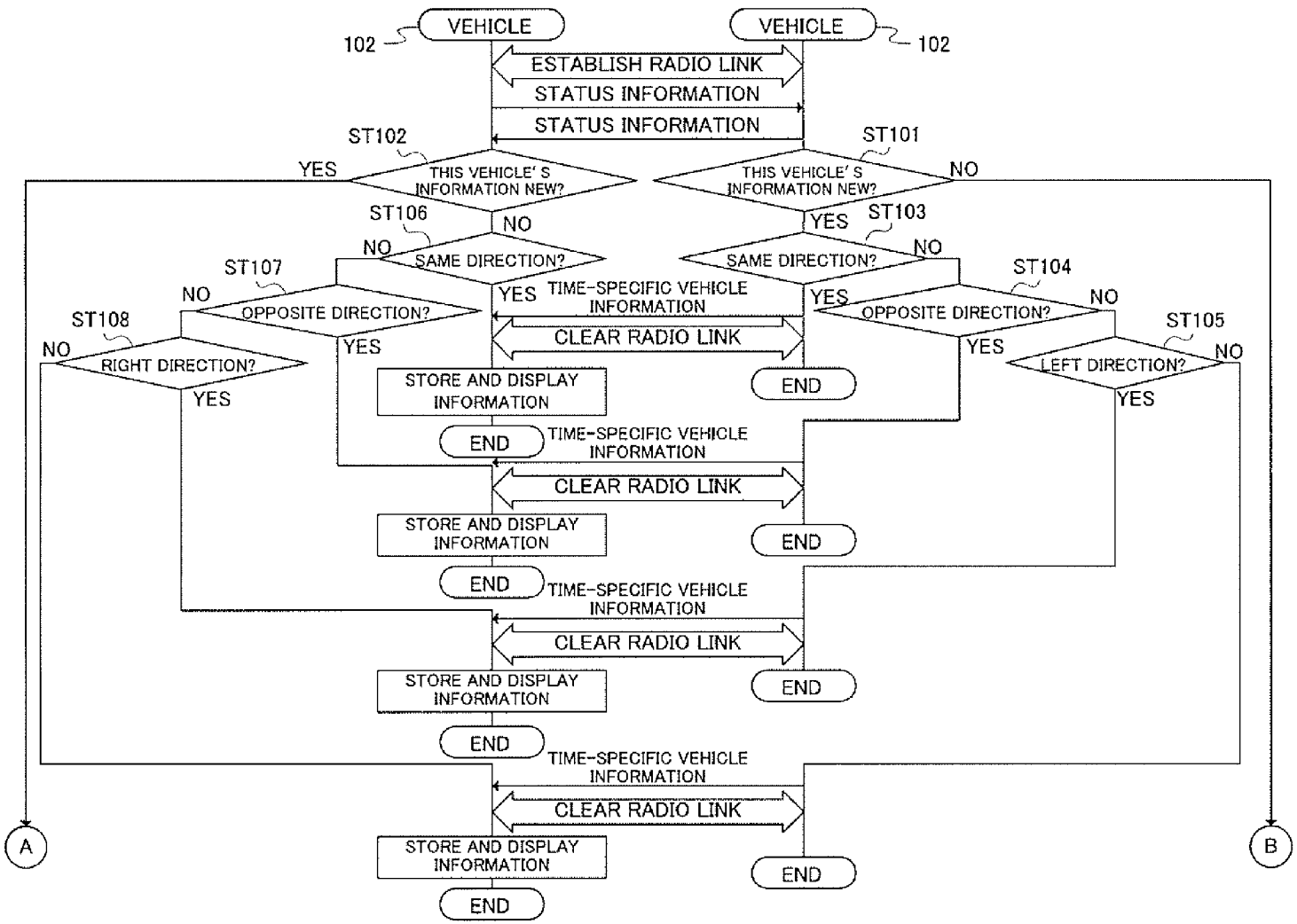
FIG. 5 is a sequence diagram for explaining the actual operation of a vehicle information and communication system according to Embodiment 1 of the present invention.
Figure 6:
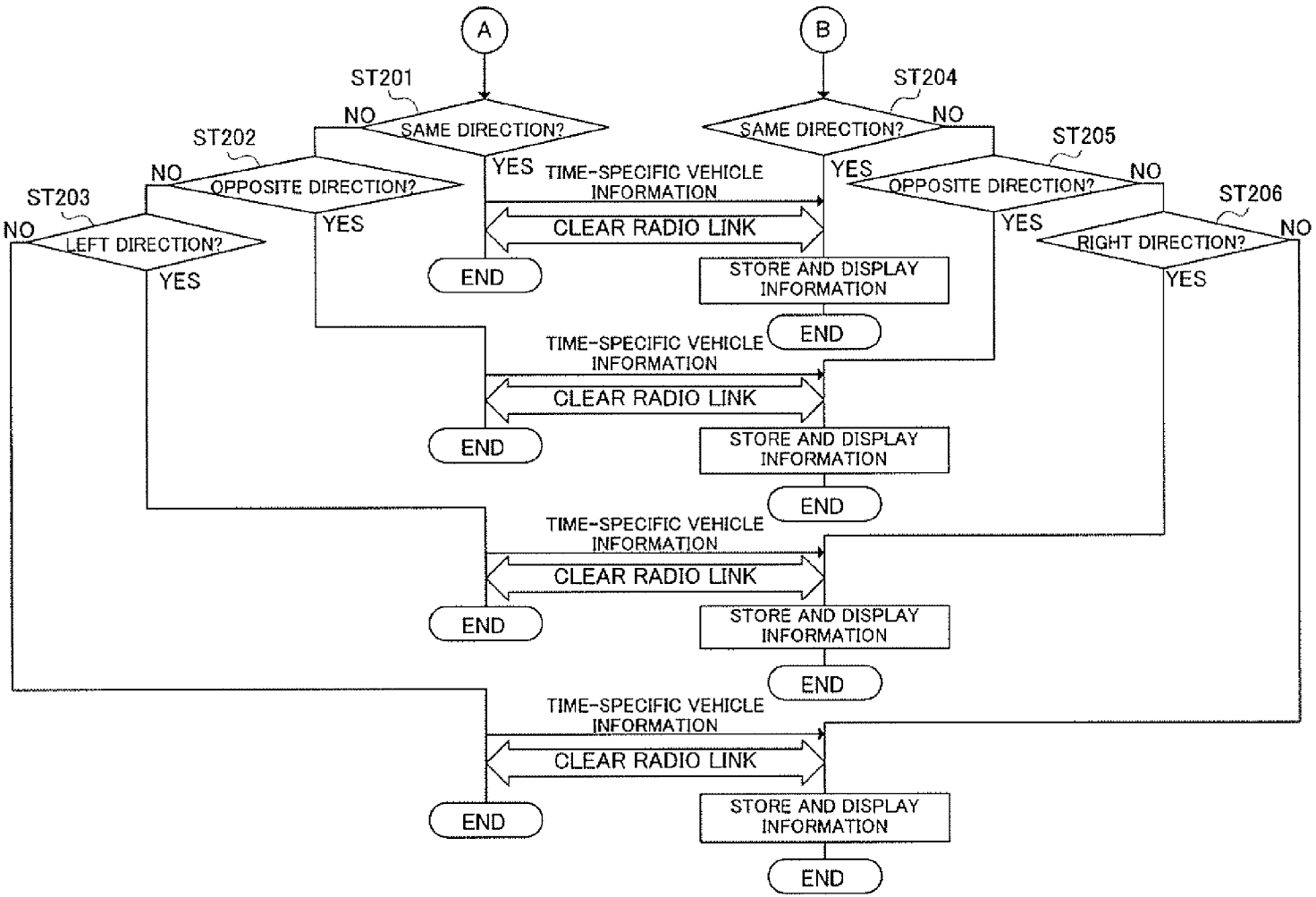
FIG. 6 is another sequence diagram for explaining the actual operation of a vehicle information and communication system according to Embodiment 1 of the present invention.

FIG. 3 is a drawing showing vehicles and a vehicle information and communication apparatus for explaining the actual operation of a vehicle information and communication system according to Embodiment 1 of the present invention. FIG. 4A through FIG. 4E are drawings for explaining vehicle information during actual operation of a vehicle information and communication system according to Embodiment 1 of the present invention. FIG. 5 is a sequence diagram for explaining the actual operation of a vehicle information and communication system according to Embodiment 1 of the present invention, and FIG. 6 is another sequence diagram for explaining the actual operation of a vehicle information and communication system according to Embodiment 1 of the present invention.

In FIG. 3, at a certain time t1 a vehicle C2(t1) acquires vehicle information from a light beacon type of vehicle information and communication apparatus R1 of a vehicle information and communication system, located near a road. Thereafter, vehicle C2(t1) turns left at an intersection. At time t2, the positions and directions of travel of vehicles C1(t2) through C5(t2) are as shown in the drawing.

Communication ranges W1 through W4 of communication apparatuses 202 of vehicles C1(t2) through C5(t2) differ according to the radio link system. In the following description it will be assumed that communication apparatuses 202 of each of vehicles C1(t2) through C5(t2) are in a radio LAN system. At time t1, light beacon communication apparatus 203 of vehicle C2(t1) acquires vehicle information from vehicle information and communication apparatus R1 and conveys this to control section 212. Control section 212 adds acquisition time information according to a clock to the vehicle information from light beacon communication apparatus 203 and generates time-specific vehicle information, and stores this in storage apparatus 205.

Figure 4A:
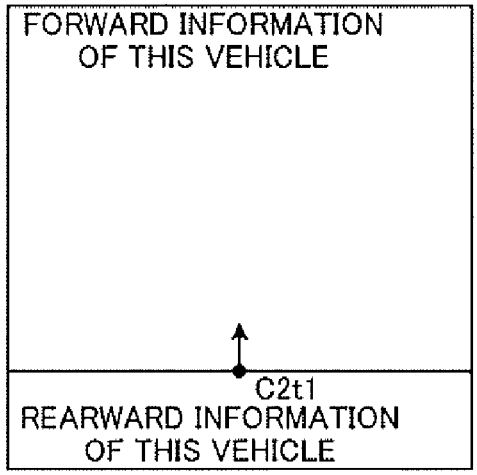
FIG. 4A is a drawing showing the vehicle information storage status at time t1 in the storage apparatus of vehicle C2(t1) of a vehicle information and communication system according to Embodiment 1 of the present invention.
Figure 4B:
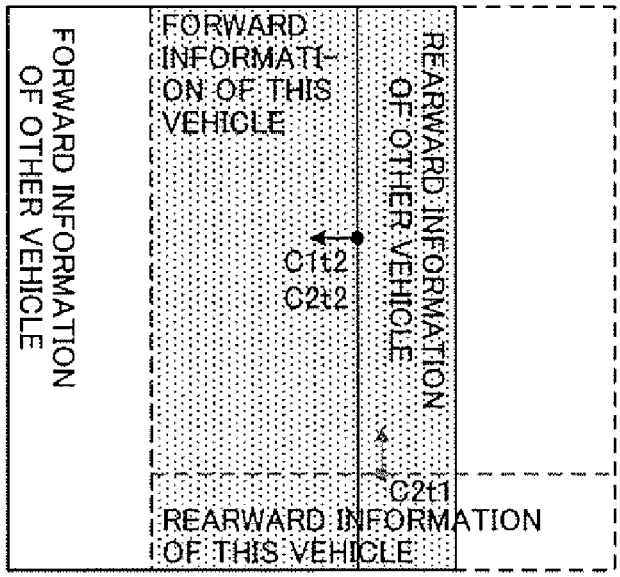
FIG. 4B is a drawing showing vehicle information transmitted to vehicle C1(t2) by the mobile communication terminal apparatus of vehicle C2(t2) when vehicle C2(t2) and vehicle C1(t2) are in the same direction in a vehicle information and communication system according to Embodiment 1 of the present invention.

FIG. 4A is a drawing showing the vehicle information storage status at time t1 in the storage apparatus of vehicle C2 (t1). FIG. 4B is a drawing showing vehicle information transmitted to vehicle C1 (t2) by the mobile communication terminal apparatus of vehicle C2 (t2) when vehicle C2(t2) and vehicle C1(t2) are in the same direction.

With light beacon type vehicle information, the amount of information generally differs in the forward and rear directions of the vehicle. For example, with light beacon type vehicle information, there is an amount of information for a 10 to 30 km area in the forward direction of the vehicle, and around a 1 km area in the rear direction of the vehicle.

After vehicle C2(t1) turns left at the intersection, communication apparatus 202 of vehicle C2(t1) receives a radio LAN beacon packet from communication apparatus 202 of vehicle C1(t2) at time t2. By this means, the mobile communication terminal apparatus of vehicle C2(t2) can learn of the existence of another communication apparatus 202. The establishment of a radio link between mobile communication terminal apparatus 102 of vehicle C2(t2) and another mobile communication terminal apparatus 102 of another vehicle is performed by means of a link establishment procedure in an ad hoc mode stipulated in IEEE802.11.

First, when a radio link is established, mobile communication terminal apparatuses 102 transmit to each other status information of vehicle information they are each holding. Status information includes time information of the time at which the newest vehicle information stored in storage apparatus 205 was acquired, and direction-of-travel information showing the direction of travel of the vehicle measured by direction finder 208. In mobile communication terminal apparatus 102 of each vehicle, based on received status information of the other vehicle and status information of the vehicle itself, time determination apparatus 209 and direction-of-travel determination apparatus 210 determine which vehicle's vehicle information is newer, or, if the vehicle information of the vehicle itself is newer, what part of the vehicle information should be transmitted to the other vehicle.

In the case of mobile communication terminal apparatus 102 of vehicle C1(t2) and mobile communication terminal apparatus 102 of vehicle C2(t2) at time t2, if it is assumed that the vehicle information acquired at time t1 by mobile communication terminal apparatus 102 of vehicle C2(t2) is new, mobile communication terminal apparatus 102 of vehicle C1(t2) knows that the vehicle information of its own vehicle is old according to time determination, and therefore transits to a state of waiting to obtain vehicle information from mobile communication terminal apparatus 102 of the other vehicle, C2(t2).

On the other hand, mobile communication terminal apparatus 102 of vehicle C2(t2) knows that the vehicle information of its own vehicle is newer according to time determination, and therefore performs determination of the direction of travel of the other vehicle, C1(t2). In this case, in the determination of the direction of travel of vehicle C1(t2) by mobile communication terminal apparatus 102 of vehicle C2(t2), since the two are traveling in the same direction, it is known that, with regard to vehicle information transmitted to mobile communication terminal apparatus 102 of vehicle C1(t2), the amount of information in the forward direction with respect to the direction of travel of its own vehicle, C2(t2), may be made larger, and the amount of information with respect to the rear direction may be made smaller. Thus, mobile communication terminal apparatus 102 of vehicle C2(t2) adds time information to information shown in the shaded area of FIG. 4B and generates first time-specific vehicle information, and transmits this to mobile communication terminal apparatus 102 of vehicle C1(t2).

Operations in mobile communication terminal apparatus 102 of vehicle C2(t2) after direction-of-travel determination will now be described in greater detail, using FIG. 4B.

At time t1, vehicle information received by light beacon communication apparatus 203 of mobile communication terminal apparatus 102 of vehicle C2(t1) is stored in storage apparatus 205 as shown by the dashed line areas of FIG. 4B. The position of vehicle C2(t1) at this time is shown by "C2t1," and the direction of travel of vehicle C2(t1) is shown by an arrow.

The position of vehicle C2 (t2) at subsequent time t2 is shown by "C2t2," and the direction of travel of vehicle C2(t2) is shown by an arrow. Also, the position of vehicle C1(t2) at time t2 is shown by "C1t2," and the direction of travel of vehicle C1(t2) is shown by an arrow. At time t2, vehicle C1(t2) is traveling in the same direction as vehicle C2(t2), and therefore control section 212 in mobile communication terminal apparatus 102 of vehicle C2(t2) specifies the range of necessary forward information and rearward information from current location C2t2 in the direction of travel of its own vehicle (the solid line area in the drawing), determines the area in which the dashed line area and solid line area overlap (the shaded area in the drawing) to be information necessary for mobile communication terminal apparatus 102 of the other vehicle, C1(t2), adds time information to the information in the shaded area and generates first time-specific vehicle information, and transmits this to mobile communication terminal apparatus 102 of vehicle C1(t2).

After finishing transmitting all the first time-specific vehicle information to be sent, mobile communication terminal apparatus 102 of vehicle C2(t2) performs a radio link clearing procedure. Having received information, mobile communication terminal apparatus 102 of vehicle C1(t2) overwrites second time-specific vehicle information in storage apparatus 205 of its own vehicle with the received first time-specific vehicle information. Also, mobile communication terminal apparatus 102 of vehicle C1(t2) displays the vehicle information stored in storage apparatus 205 on a display apparatus.

Figure 4C:
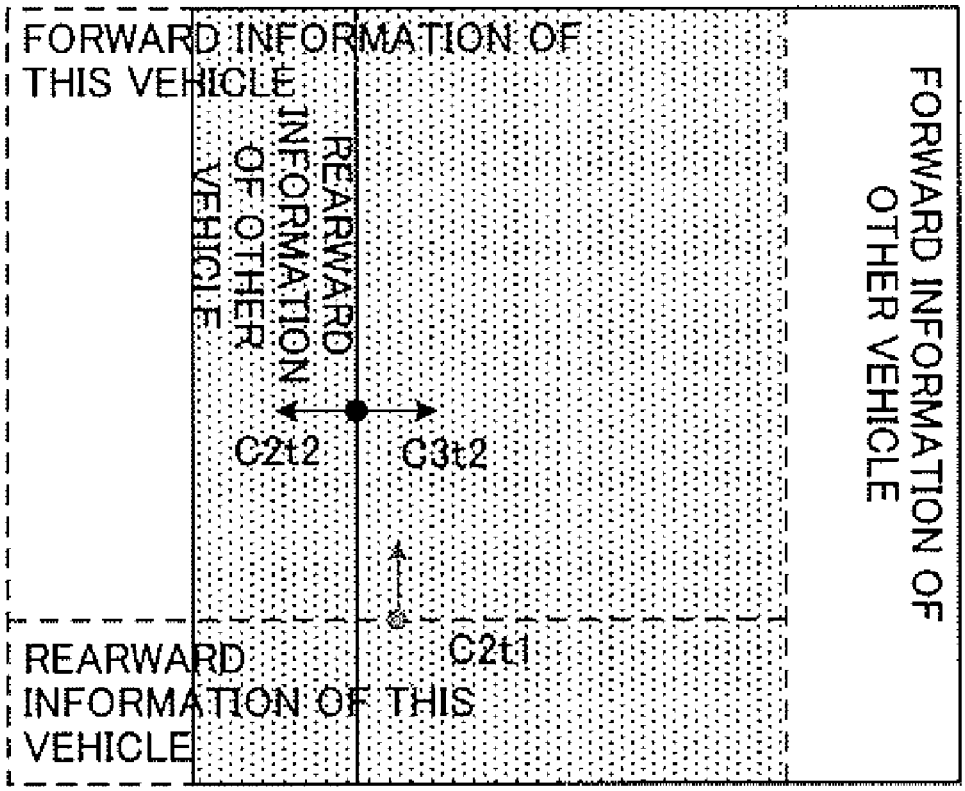
FIG. 4C is a drawing showing vehicle information transmitted to vehicle C3(t2) by the mobile communication terminal apparatus of vehicle C2(t2) when vehicle C2(t2) and vehicle C3(t2) pass each other in a vehicle information and communication system according to Embodiment 1 of the present invention.

FIG. 4C is a drawing showing vehicle information transmitted to vehicle C3(t2) by the mobile communication terminal apparatus of vehicle C2(t2) when vehicle C2(t2) and vehicle C3(t2) pass each other in a vehicle information and communication system according to Embodiment 1 of the present invention. In this case, mobile communication terminal apparatus 102 of vehicle C2(t2) specifies the range of necessary vehicle information with respect to the direction of travel of vehicle C3(t2), and selects, from the vehicle information held by mobile communication terminal apparatus 102 of vehicle C2, the part overlapping the specified range as reported vehicle information.

Figure 4D:
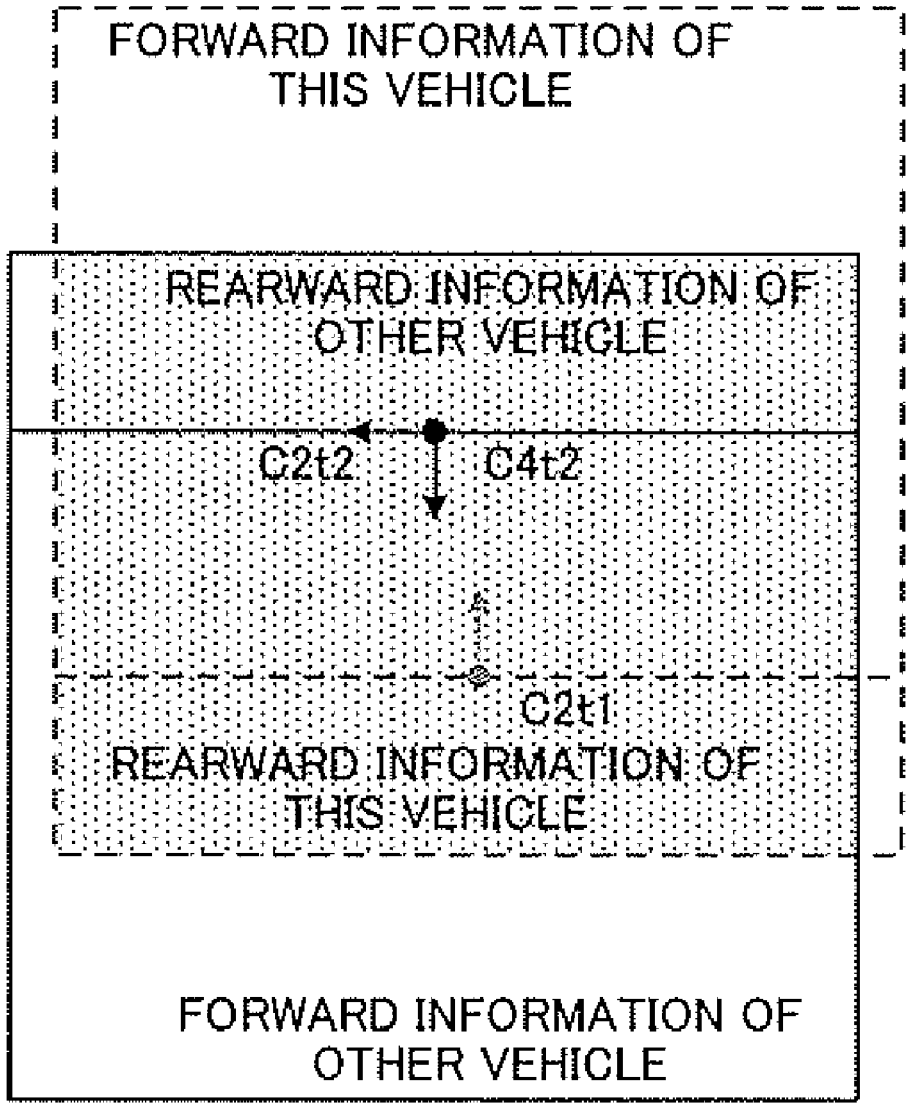
FIG. 4D is a drawing showing vehicle information transmitted to vehicle C4(t2) by vehicle C2(t2) when vehicle C4(t2) approaches vehicle C2(t2) from the right in a vehicle information and communication system according to Embodiment 1 of the present invention.

FIG. 4D is a drawing showing vehicle information transmitted to vehicle C4(t2) by vehicle C2(t2) when vehicle C4(t2) approaches vehicle C2(t2) from the right. In this case, mobile communication terminal apparatus 102 of vehicle C2(t2) specifies the range of necessary vehicle information with respect to the direction of travel of vehicle C4(t2), and selects, from the vehicle information held by mobile communication terminal apparatus 102 of vehicle C2(t2), the part overlapping the specified range as reported vehicle information.

Figure 4E:
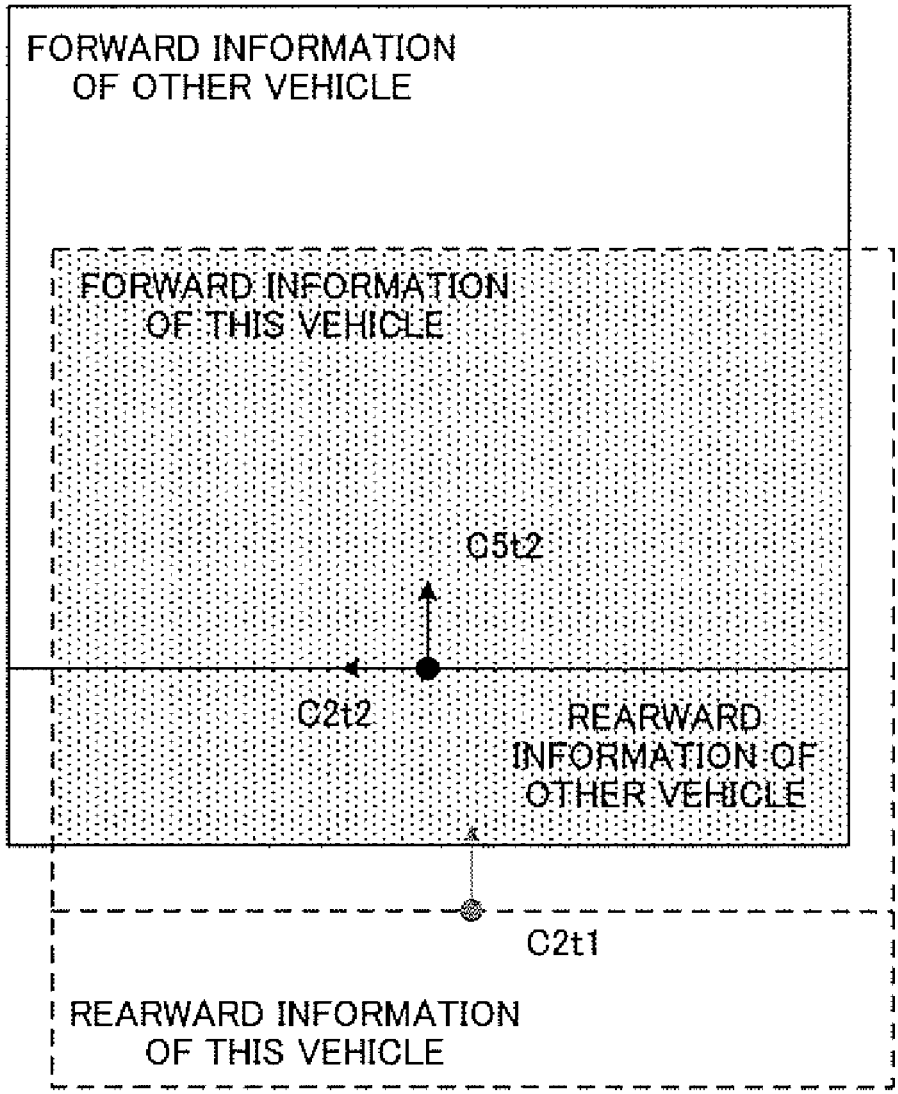
FIG. 4E is a drawing showing vehicle information transmitted to vehicle C5(t2) by vehicle C2(t2) when vehicle C5(t2) approaches vehicle C2(t2) from the left in a vehicle information and communication system according to Embodiment 1 of the present invention.

FIG. 4E is a drawing showing vehicle information transmitted to vehicle C5(t2) by vehicle C2(t2) when vehicle C5(t2) approaches vehicle C2(t2) from the left. In this case, mobile communication terminal apparatus 102 of vehicle C2(t2) specifies the range of necessary vehicle information with respect to the direction of travel of vehicle C5, and selects, from the vehicle information held by mobile communication terminal apparatus 102 of vehicle C2(t2), the part overlapping the specified range as reported vehicle information.

Communication of time-specific vehicle information by the mobile communication terminal apparatuses of two vehicles in a vehicle information and communication system of the present invention will now be described in greater detail, with reference to FIG. 5 and FIG. 6.

FIG. 5 is a sequence diagram showing a time-specific vehicle information updating sequence used by the mobile communication terminal apparatuses of two vehicles that have established a radio link. FIG. 6 is another sequence diagram showing another time-specific vehicle information updating sequence used by the mobile communication terminal apparatuses of two vehicles that have established a radio link.

Mobile communication terminal apparatuses 102 of the two vehicles acquire vehicle information from a light beacon type vehicle information and communication apparatus 101 of vehicle information and communication system 100, located near a road. Mobile communication terminal apparatuses 102 of the two vehicles add respective time information to the acquired vehicle information and generate time-specific vehicle information, and store this in storage apparatus 205.

As shown in FIG. 5, after establishing a radio link, mobile communication terminal apparatuses 102 of the two vehicles transmit status information to each other. In steps ST101 and ST102 respectively, mobile communication terminal apparatuses 102 of the two vehicles determine, with regard to time-specific vehicle information, whether or not the information of that vehicle is new based on time information of status information.

If the information of that vehicle 102 is new in step ST101, in steps ST103, ST104, and ST105, mobile communication terminal apparatus 102 of that vehicle 102 determines same direction, opposite direction, or left direction based on direction-of-travel information of status information from mobile communication terminal apparatus 102 of the other vehicle, selects time-specific vehicle information based on that determination result, transmits this to mobile communication terminal apparatus 102 of the other vehicle, and clears the radio link.

If the information of that vehicle 102 is not new in step ST102, in steps ST106, ST107, and ST108, mobile communication terminal apparatus 102 of that vehicle 102 determines same direction, opposite direction, or right direction based on direction-of-travel information of status information from mobile communication terminal apparatus 102 of the other vehicle, and performs time-specific vehicle information storage and display based on that determination result.

As shown in FIG. 5 and FIG. 6, if the information of that vehicle 102 is new in step ST102, in steps ST201, ST202, and ST203, mobile communication terminal apparatus 102 of that vehicle 102 determines same direction, opposite direction, or left direction based on direction-of-travel information of status information from mobile communication terminal apparatus 102 of the other vehicle, selects time-specific vehicle information based on that determination result, transmits this to mobile communication terminal apparatus 102 of the other vehicle, and clears the radio link.

As shown in FIG. 5 and FIG. 6, if the information of that vehicle 102 is not new in step ST101, in steps ST204, ST205, and ST206, mobile communication terminal apparatus 102 of that vehicle 102 determines same direction, opposite direction, or right direction based on direction-of-travel information of status information from mobile communication terminal apparatus 102 of the other vehicle, and performs time-specific vehicle information storage and display based on that determination result.

Thus, in Embodiment 1 of the present invention, a mobile communication terminal apparatus of a vehicle can select only necessary information from stored vehicle information, and transmit that information to a mobile communication terminal apparatus of another vehicle.

Embodiment 2

Embodiment 2 of the present invention will now be described in detail with reference to the accompanying drawings.

Figure 7:
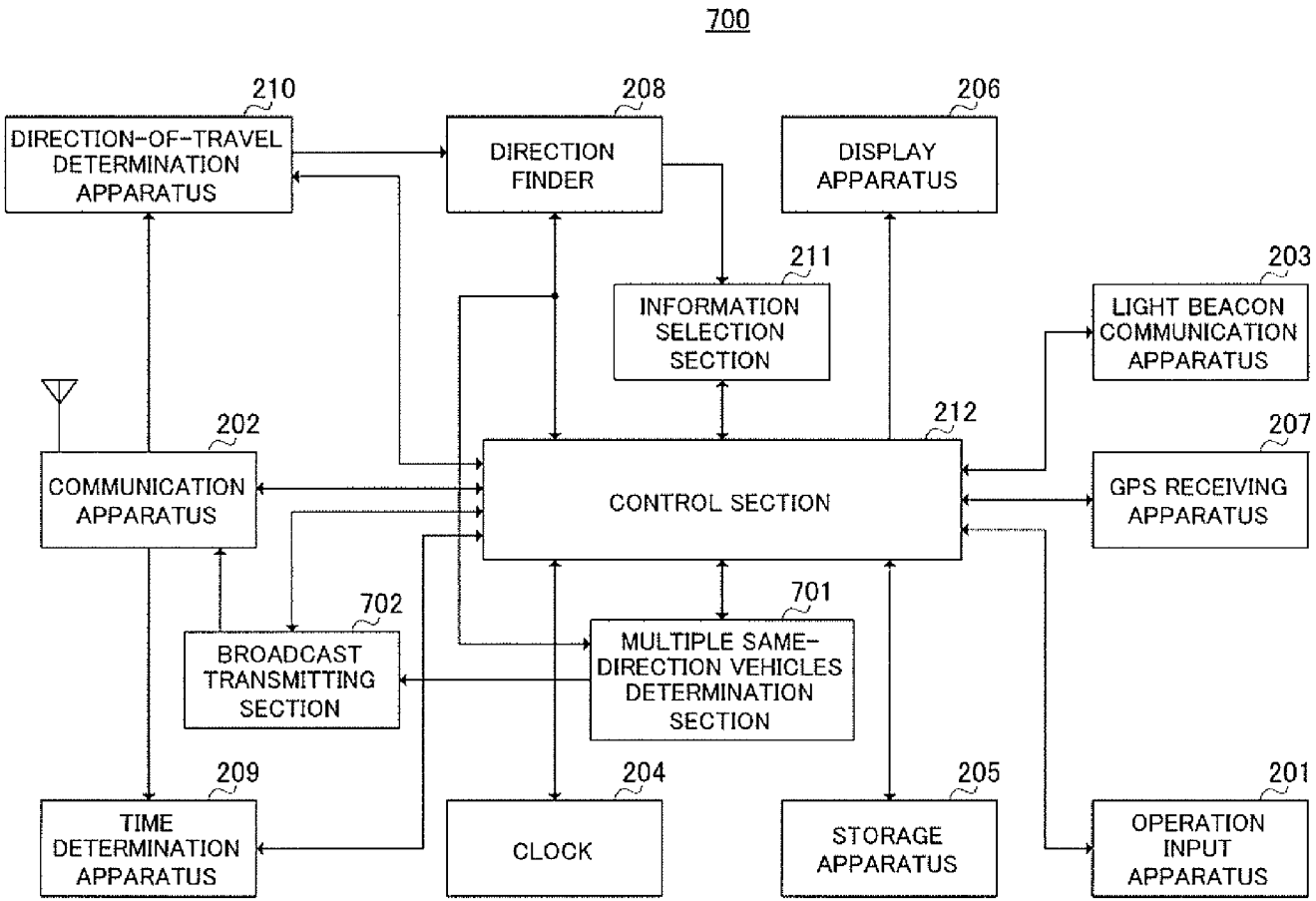
FIG. 7 is a block diagram showing the configuration of a mobile communication terminal apparatus of a vehicle information and communication system according to Embodiment 2 of the present invention.

FIG. 7 is a block diagram showing the configuration of a mobile communication terminal apparatus of a vehicle information and communication system according to Embodiment 2 of the present invention.

Figure 8:
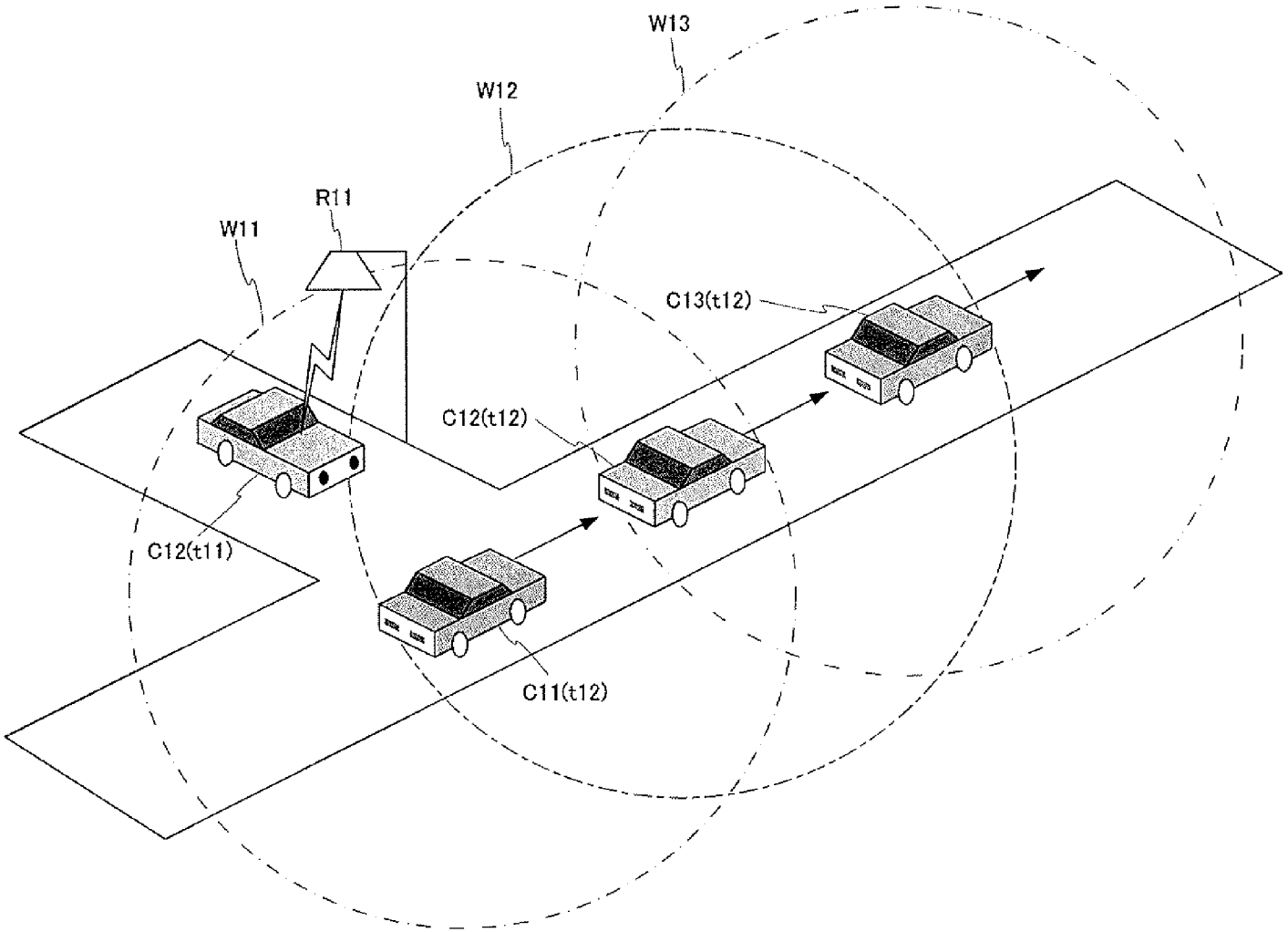
FIG. 8 is a drawing showing vehicles and a vehicle information and communication apparatus for explaining the actual operation of a vehicle information and communication system according to Embodiment 2 of the present invention.
Figure 9:
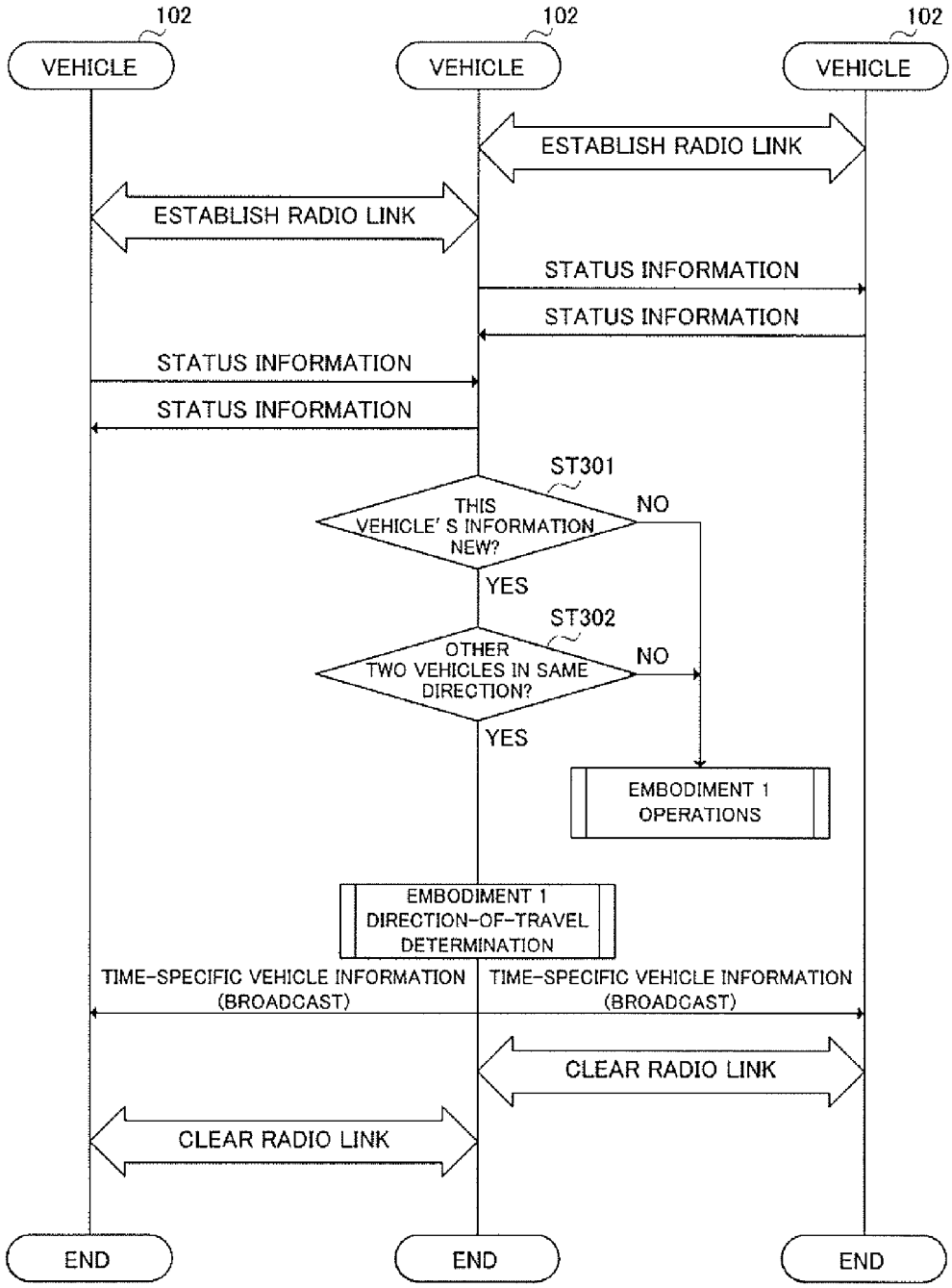
FIG. 9 is a sequence diagram for explaining the actual operation of a vehicle information and communication system according to Embodiment 2 of the present invention.

FIG. 7 is a drawing showing vehicles and a vehicle information and communication apparatus for explaining the actual operation of a vehicle information and communication system according to Embodiment 2 of the present invention. FIG. 8 is a drawing showing vehicles and a vehicle information and communication apparatus for explaining the actual operation of a vehicle information and communication system according to Embodiment 2 of the present invention. FIG. 9 is a sequence diagram for explaining the actual operation of a vehicle information and communication system according to Embodiment 2 of the present invention. In Embodiment 2 of the present invention, configuration elements identical to those in Embodiment 1 are assigned the same reference numerals as in Embodiment 1, and descriptions thereof are omitted.

As shown in FIG. 7, in a vehicle information and communication system 700 according to Embodiment 2 of the present invention, a multiple same-direction vehicles determination section 701 and a broadcast transmitting section 702 have been added to vehicle information and communication system 100 according to Embodiment 1 shown in FIG. 1 and FIG. 2.

Multiple same-direction vehicles determination section 701 determines whether or not there are a plurality of vehicles traveling in the same direction based on direction-of-travel information from direction finder 208, generates a same-direction determination result, and conveys this to control section 212 and broadcast transmitting section 702. If it is determined from the same-direction determination result from multiple same-direction vehicles determination section 701 that there are a plurality of vehicles traveling in the same direction, broadcast transmitting section 702 performs broadcast transmission of second time-specific vehicle information selected by information selection section 211 via control section 212 and communication apparatus 202.

As shown in FIG. 7, at a certain time t11 a vehicle C12(t11) acquires vehicle information from a light beacon type of vehicle information and communication apparatus R11 of a vehicle information and communication system, located near a road. Thereafter, vehicle C12(t11) turns left at an intersection. At time t12, the positions and directions of travel of vehicles C11(t12) through C13(t12) are as shown in the drawing.

Communication ranges W11 through W13 of communication apparatuses 202 of the vehicles differ according to the radio link system. In the following description it will be assumed that communication apparatuses 202 of the vehicles are in a radio LAN system. At time t11, light beacon communication apparatus 205 of vehicle C12(t11) acquires vehicle information from vehicle information and communication apparatus R1 and conveys this to control section 212. Control section 212 adds acquisition time information according to a clock to the vehicle information from light beacon communication apparatus 203 and generates time-specific vehicle information, and stores this in storage apparatus 205.

Communication ranges W1 through W3 of communication apparatuses 202 of the vehicles differ according to the radio link system. In the following description it will be assumed that communication apparatuses 202 of the vehicles are in a radio LAN system. At time t11, light beacon communication apparatus 203 of vehicle C12(t11) acquires vehicle information from vehicle information and communication apparatus R11 and conveys this to control section 212. Control section 212 adds acquisition time information according to a clock to the vehicle information from light beacon communication apparatus 203 and generates time-specific vehicle information, and stores this in storage apparatus 205.

After vehicle C12(t11) turns left at the intersection, communication apparatus 202 of vehicle C12(t11) receives radio LAN beacon packets from communication apparatuses 202 of vehicle C11(t12) and vehicle C13(t12) at time t12. By this means, the mobile communication terminal apparatus 202 of vehicle C12(t12) can learn of the existence of other communication apparatuses 202. The establishment of a radio link between communication apparatus 202 of vehicle C12(t12) and another communication apparatus 202 of another vehicle is performed by means of a link establishment procedure in an ad hoc mode stipulated in IEEE802.11.

First, when a radio link is established, mobile communication terminal apparatuses 102 of vehicles C11(t12) through C13(t12) transmit to each other status information of vehicle information they are each holding. Status information includes time information of the time at which the newest vehicle information stored in storage apparatus 205 was acquired, and direction-of-travel information showing the direction of travel of the vehicle measured by the direction finder. In mobile communication terminal apparatus 102 of each of vehicles C11(t12) through C13(t12), based on received status information of another vehicle and status information of the vehicle itself, time determination apparatus 209 and direction-of-travel determination apparatus 210 determine which vehicle's vehicle information is newer, or, if the vehicle information of the vehicle itself is newer, what part of the time-specific vehicle information should be transmitted to another vehicle.

Here, if the time-specific vehicle information held by mobile communication terminal apparatus 102 of vehicle C2(t12) is the newest, determination of the direction of travel of a plurality of other vehicles is performed. If there are a plurality of vehicles traveling in the same direction, mobile communication terminal apparatus 102 of vehicle C12(t12) selects time-specific vehicle information necessary for these vehicles, and then performs broadcast transmission of that information. By this means, it is possible for mobile communication terminal apparatus 102 of vehicle C12(t12) to perform transmission of time-specific vehicle information only once to a plurality of vehicles, enabling communication time to be shortened and the used bandwidth to be reduced.

Communication of time-specific vehicle information by the mobile communication terminal apparatuses of three vehicles in a vehicle information and communication system the present invention will now be described in greater detail, with reference to FIG. 9.

FIG. 9 is a sequence diagram showing a time-specific vehicle information updating sequence used by the mobile communication terminal apparatuses of three vehicles that have established a radio link.

Mobile communication terminal apparatuses 102 of the three vehicles acquire vehicle information from light beacon type vehicle information and communication apparatus R11 of the vehicle information and communication system, located near a road. Mobile communication terminal apparatuses 102 of the three vehicles add respective time information to the acquired vehicle information and generate time-specific vehicle information, and store this in storage apparatus 205.

As shown in FIG. 9, after establishing a radio link, mobile communication terminal apparatuses 102 of the three vehicles transmit status information to each other. In step ST301, mobile communication terminal apparatuses 102 of the three vehicles determine, with regard to time-specific vehicle information, whether or not the information of that vehicle is new based on time information of status information.

If the information of that vehicle 102 is not new in step ST301, mobile communication terminal apparatus 102 in that vehicle executes the operations of Embodiment 1 of the present invention shown in FIG. 5 and FIG. 6. If the information of that vehicle is new, in step ST302 mobile communication terminal apparatus 102 in that vehicle determines whether or not the directions of travel of the other two vehicles are the same. If the directions of travel of the other two vehicles are not the same in step ST302, mobile communication terminal apparatus 102 in that vehicle executes the operations of Embodiment 1 of the present invention shown in FIG. 5 and FIG. 6.

If the directions of travel of the other two vehicles are the same in step ST302, mobile communication terminal apparatus 102 in that vehicle performs the direction-of-travel determination shown in Embodiment 1 of the present invention shown in FIG. 5 and FIG. 6, performs selection of time-specific vehicle information based on these determination results, and performs broadcast transmission of the selected information to mobile communication terminal apparatuses 102 of the other two vehicles.

Thus, in Embodiment 2 of the present invention, a mobile communication terminal apparatus of a vehicle can select only necessary information from stored vehicle information, and transmit that information to a mobile communication terminal apparatus of another vehicle. Also, in Embodiment 2 of the present invention, when there are a plurality of vehicles traveling in the same direction, it is possible to select only necessary information from vehicle information, and perform broadcast transmission of that information.

A vehicle information and communication system according to a first aspect of the present invention is equipped with a plurality of vehicle information and communication apparatuses that are located near a road at intervals and transmit vehicle information, and a plurality of mobile communication terminal apparatuses that are provided in a plurality of vehicles, and employs a configuration wherein each of the plurality of mobile communication terminal apparatuses includes: a vehicle information acquisition section that acquires the vehicle information from the vehicle information and communication apparatuses; a clock that measures the current time and generates first time information; a time-specific vehicle information storage section that adds the first time information from the clock to the vehicle information from the vehicle information acquisition section, and generates and stores first time-specific vehicle information; a display section that displays information including the first time-specific vehicle information stored in the time-specific vehicle information storage section; a positional information acquisition section that acquires positional information showing the current position of that mobile communication terminal apparatus; a direction finder that measures the direction of travel of the vehicle equipped with that mobile communication terminal apparatus, and generates direction-of-travel information; a time determination section that receives second time information from another mobile communication terminal apparatus, selects part of the first time-specific vehicle information when the first time of the first time information of the first time-specific vehicle information is newer than the second time of that second time information, and generates an information transmission directive for transmission thereof; an information selection section that, based on other direction-of-travel information showing the direction of travel of another vehicle from the other mobile communication terminal apparatus at the time of generation of the information transmission directive by the time determination section and the direction-of-travel information from the direction finder, selects the part of the first time-specific vehicle information and generates second time-specific vehicle information; an information transmitting section that transmits the second time-specific vehicle information selected by the information selection section to the other mobile communication terminal apparatus; and a storage control section that overwrites the first time-specific vehicle information of the time-specific vehicle information storage section when third time-specific vehicle information is received from another mobile communication terminal apparatus.

According to this configuration, a mobile communication terminal apparatus of a vehicle can select only necessary information from stored vehicle information, and transmit that information to a mobile communication terminal apparatus of another vehicle.

A vehicle information and communication system according to a second aspect of the present invention employs a configuration that includes, in the first aspect of the present invention: a multiple same-direction vehicles determination section that determines whether or not there are a plurality of vehicles traveling in the same direction; and a broadcast transmitting section that, if it is determined by the multiple same-direction vehicles determination section that there are a plurality of vehicles traveling in the same direction, performs broadcast transmission of second time-specific vehicle information selected by the information selection section.

According to this configuration, a mobile communication terminal apparatus of a vehicle can select only necessary information from stored vehicle information, and transmit that information to a mobile communication terminal apparatus of another vehicle. Also, according to this configuration, when there are a plurality of vehicles traveling in the same direction, it is possible to select only necessary information from vehicle information, and perform broadcast transmission of that information.

A vehicle information and communication method according to a third aspect of the present invention is a vehicle information and communication method in a vehicle information and communication system equipped with a plurality of vehicle information and communication apparatuses that are located near a road at intervals and transmit vehicle information, and a plurality of mobile communication terminal apparatuses that are provided in a plurality of vehicles, wherein each of the plurality of mobile communication terminal apparatuses includes a vehicle information acquisition section that acquires the vehicle information from the vehicle information and communication apparatuses; a clock that measures the current time and generates first time information; a time-specific vehicle information storage section that adds the first time information from the clock to the vehicle information from the vehicle information acquisition section, and generates and stores first time-specific vehicle information; a display section that displays information including the first time-specific vehicle information stored in the time-specific vehicle information storage section; a positional information acquisition section that acquires positional information showing the current position of that mobile communication terminal apparatus; and a direction finder that measures the direction of travel of the vehicle equipped with that mobile communication terminal apparatus, and generates direction-of-travel information; wherein the vehicle information and communication method includes: a time determination step of receiving second time information from another mobile communication terminal apparatus, selecting part of the first time-specific vehicle information when the first time of the first time information of the first time-specific vehicle information is newer than the second time of that second time information, and generating an information transmission directive for transmission thereof; an information selection step of, based on other direction-of-travel information showing the direction of travel of another vehicle from the other mobile communication terminal apparatus at the time of generation of the information transmission directive in the time determination step and the direction-of-travel information from the direction finder, selecting the part of the first time-specific vehicle information and generating second time-specific vehicle information; an information transmitting step of transmitting the second time-specific vehicle information selected in the information selection step to the other mobile communication terminal apparatus; and a storage control step of overwriting the first time-specific vehicle information of the time-specific vehicle information storage section when third time-specific vehicle information is received from another mobile communication terminal apparatus.

According to this method, a mobile communication terminal apparatus of a vehicle can select only necessary information from stored vehicle information, and transmit that information to a mobile communication terminal apparatus of another vehicle.

A vehicle information and communication program according to a fourth aspect of the present invention is a vehicle information and communication program in a vehicle information and communication system equipped with a plurality of vehicle information and communication apparatuses that are located near a road at intervals and transmit vehicle information, and a plurality of mobile communication terminal apparatuses that are provided in a plurality of vehicles, wherein each of the plurality of mobile communication terminal apparatuses includes: a vehicle information acquisition section that acquires the vehicle information from the vehicle information and communication apparatuses; a clock that measures the current time and generates first time information; a time-specific vehicle information storage section that adds the first time information from the clock to the vehicle information from the vehicle information acquisition section, and generates and stores first time-specific vehicle information; a display section that displays information including the first time-specific vehicle information stored in the time-specific vehicle information storage section; a positional information acquisition section that acquires positional information showing the current position of that mobile communication terminal apparatus; and a direction finder that measures the direction of travel of the vehicle equipped with that mobile communication terminal apparatus, and generates direction-of-travel information; wherein the vehicle information and communication program causes a computer to execute: a time determination step of receiving second time information from another mobile communication terminal apparatus, selecting part of the first time-specific vehicle information when the first time of the first time information of the first time-specific vehicle information is newer than the second time of that second time information, and generating an information transmission directive for transmission thereof; an information selection step of, based on other direction-of-travel information showing the direction of travel of another vehicle from the other mobile communication terminal apparatus at the time of generation of the information transmission directive in the time determination step and the direction-of-travel information from the direction finder, selecting the part of the first time-specific vehicle information and generating second time-specific vehicle information; an information transmitting step of transmitting the second time-specific vehicle information selected in the information selection step to the other mobile communication terminal apparatus; and a storage control step of overwriting the first time-specific vehicle information of the time-specific vehicle information storage section when third time-specific vehicle information is received from another mobile communication terminal apparatus.

According to this configuration, a mobile communication terminal apparatus of a vehicle can select only necessary information from stored vehicle information, and transmit that information to a mobile communication terminal apparatus of another vehicle.

A mobile communication terminal apparatus according to a fifth aspect of the present invention is a mobile communication terminal apparatus in a vehicle information and communication system equipped with a plurality of vehicle information and communication apparatuses that are located near a road at intervals and transmit vehicle information, and a plurality of mobile communication terminal apparatuses that are provided in a plurality of vehicles, and employs a configuration that includes: a vehicle information acquisition section that acquires the vehicle information from the vehicle information and communication apparatuses; a clock that measures the current time and generates first time information; a time-specific vehicle information storage section that adds the first time information from the clock to the vehicle information from the vehicle information acquisition section, and generates and stores first time-specific vehicle information; a display section that displays information including the first time-specific vehicle information stored in the time-specific vehicle information storage section; a positional information acquisition section that acquires positional information showing the current position of that mobile communication terminal apparatus; a direction finder that measures the direction of travel of the vehicle equipped with that mobile communication terminal apparatus, and generates direction-of-travel information; a time determination section that receives second time information from another mobile communication terminal apparatus, selects part of the first time-specific vehicle information when the first time of the first time information of the first time-specific vehicle information is newer than the second time of that second time information, and generates an information transmission directive for transmission thereof; an information selection section that, based on other direction-of-travel information showing the direction of travel of another vehicle from the other mobile communication terminal apparatus at the time of generation of the information transmission directive by the time determination section and the direction-of-travel information from the direction finder, selects the part of the first time-specific vehicle information and generates second time-specific vehicle information; an information transmitting section that transmits the second time-specific vehicle information selected by the information selection section to the other mobile communication terminal apparatus; and a storage control section that overwrites the first time-specific vehicle information of the time-specific vehicle information storage section when third time-specific vehicle information is received from another mobile communication terminal apparatus.

According to this configuration, a mobile communication terminal apparatus of a vehicle can select only necessary information from stored vehicle information, and transmit that information to a mobile communication terminal apparatus of another vehicle.

The present application is based on Japanese Patent Application No. 2004-127241 filed on Apr. 22, 2004, entire content of which is expressly incorporated herein by reference.

INDUSTRIAL APPLICABILITY

The present invention has an effect of enabling a mobile communication terminal apparatus of a vehicle to select only necessary information from stored vehicle information, and transmit that information to a mobile communication terminal apparatus of another vehicle, and is suitable for use in a vehicle information and communication system and a vehicle information and communication method.

The invention claimed is:

1. A mobile communication terminal apparatus configured to be mounted on a first vehicle, the mobile communication terminal comprising:

an acquirer that acquires road traffic information from road traffic information communication apparatuses located at intervals, the road traffic information being obtained by the road traffic information communication apparatuses from a traffic information source other than the mobile communication terminal apparatus;

a storage that stores first time-specific road traffic information comprising the acquired road traffic information to which a time that the road traffic information was acquired is added;

a direction measurer that measures a traveling direction of the first vehicle on which the mobile communication terminal is mounted and generates traveling direction information;

a first receiver that receives traveling direction information indicating a traveling direction of a second vehicle distinct from the first vehicle on which the mobile communication terminal is mounted;

an information selector that selects part of the stored first time-specific road traffic information, as second time-specific road traffic information, based on both the traveling direction of the first vehicle and the traveling direction of the second vehicle, to acquire road traffic information relevant to the second vehicle; and a transmitter that transmits the selected second time-specific road traffic information from the first vehicle on which the mobile communication terminal is mounted to the second vehicle.

2. The mobile communication terminal apparatus according to claim 1, wherein the information selector selects part of the first time-specific road traffic information for an area corresponding to the traveling direction of the second vehicle.

3. The mobile communication terminal apparatus according to claim 1, further comprising a time determiner that determines a first acquisition time that road traffic information is acquired in the acquirer of the mobile communication terminal apparatus mounted on the first vehicle and a second acquisition time that the road traffic information is acquired by the second vehicle, wherein the information selector selects part of the first time-specific road traffic information that is acquired, only when the first acquisition time is preceded by the second acquisition time.

4. The mobile communication terminal apparatus according to claim 1, further comprising a second receiver that receives the second time-specific road traffic information from another mobile communication terminal apparatus mounted on the second vehicle, wherein the storage reflects the received second time-specific road traffic information in the stored first time-specific road traffic information.

5. The mobile communication terminal apparatus according to claim 1, further comprising:

a determiner that determines whether or not there are a plurality of other vehicles traveling in the same direction as the first vehicle; and a broadcast transmitter that performs a broadcast transmission of the second time-specific road traffic information when there are the plurality of other vehicles.

6. The mobile communication terminal apparatus according to claim 1, wherein the first vehicle contains the mobile communication terminal apparatus.

7. A road traffic information communication system comprising:

a plurality of road traffic information communicators that are located at intervals and that transmit road traffic information; and a plurality of mobile communication terminal apparatuses mounted on a plurality of vehicles respectively, wherein each of the plurality of mobile communication terminal apparatuses comprises:

an acquirer that acquires road traffic information from the road traffic information communicators, the road traffic information being obtained by the road traffic information communicators from a traffic information source other than the mobile communication terminal apparatus;

a storage that stores first time-specific road traffic information comprising the acquired road traffic information to which a time that the road traffic information was acquired is added;

a direction measurer that measures a traveling direction of a first vehicle having the mobile communication terminal apparatus mounted thereon and generates traveling direction information;

a receiver that receives traveling direction information indicating a traveling direction of a second vehicle having another mobile communication terminal apparatus mounted thereon;

an information selector that selects part of the stored first time-specific road traffic information, as second time-specific road traffic information, based on both the traveling direction of the first vehicle having the mobile communication terminal apparatus mounted thereon and the traveling direction of the second vehicle, to acquire road traffic information relevant to the second vehicle; and a transmitter that transmits the selected second time-specific road traffic information, from the first vehicle having the mobile communication terminal apparatus mounted thereon, to the other mobile communication terminal apparatus mounted on the second vehicle.

8. A method of communicating road traffic information between apparatuses in a road traffic communication system comprising a plurality of road traffic information communicators that are located at intervals and transmit road traffic information and a plurality of mobile communication terminal apparatuses that are mounted on a plurality of vehicles respectively, the method comprising, at each of the plurality of mobile communication terminal apparatuses:

acquiring road traffic information from the road traffic information communicators, the road traffic information being obtained by the road traffic information communicators from a traffic information source other than the mobile communication terminal apparatus;

storing first time-specific road traffic information comprising the acquired road traffic information to which a time that the road traffic information was acquired is added;

measuring a traveling direction of a first vehicle having the mobile communication terminal apparatus mounted thereon and generating traveling direction information;

receiving traveling direction information indicating a traveling direction of a second vehicle having another mobile communication terminal apparatus mounted thereon;

selecting part of the stored first time-specific road traffic information, as second time-specific road traffic information, based on both the traveling direction of the first vehicle and the traveling direction of the second vehicle, to acquire road traffic information relevant to the second vehicle; and transmitting the selected second time-specific road traffic information from the first vehicle having the mobile communication terminal apparatus mounted thereon to the other mobile communication terminal apparatus mounted on the second vehicle.

9. A non-transitory computer readable medium that is stored in a mobile communication terminal apparatus to be mounted on a first vehicle, the computer readable medium storing an executable road traffic information communication program that causes a computer to execute:

acquiring road traffic information from road traffic information communicators, the road traffic information being obtained by the road traffic information communicators from a traffic information source other than the mobile communication terminal apparatus;

storing first time-specific road traffic information comprising the acquired road traffic information to which a time that the road traffic information was acquired is added;

measuring a traveling direction of a first vehicle having the mobile communication terminal apparatus mounted thereon and generating traveling direction information;

receiving traveling direction information indicating a traveling direction of a second vehicle having another mobile communication terminal apparatus mounted thereon;

selecting part of the stored first time-specific road traffic information, as second time-specific road traffic information, based on both the traveling direction of the first vehicle and the traveling direction of the second vehicle, to acquire road traffic information relevant to the second vehicle; and transmitting the selected second time-specific road traffic information, from the first vehicle having the terminal apparatus mounted thereon, to the other mobile communication terminal apparatus mounted on the second vehicle.

10. The computer readable medium according to claim 9, the first vehicle containing the mobile communication terminal apparatus.

* * * * *